US009735494B2

(12) United States Patent
Herring et al.

(10) Patent No.: US 9,735,494 B2
(45) Date of Patent: Aug. 15, 2017

(54) PLUGGABLE CONNECTOR HAVING A PROTECTIVE FRONT WALL

(71) Applicant: Tyco Electronics Corporation, Berwyn, PA (US)

(72) Inventors: Michael David Herring, Apex, NC (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 5 days.

(21) Appl. No.: 14/266,755

(22) Filed: Apr. 30, 2014

(65) Prior Publication Data

US 2015/0318633 A1 Nov. 5, 2015

(51) Int. Cl.

| | |
|---|---|
| ***H01R 13/453*** | (2006.01) |
| ***H01R 13/717*** | (2006.01) |
| ***H01R 13/66*** | (2006.01) |
| *H01R 13/447* | (2006.01) |
| *H01R 12/62* | (2011.01) |

(52) U.S. Cl.

CPC ..... *H01R 13/4538* (2013.01); *H01R 13/66* (2013.01); *H01R 13/717* (2013.01); *H01R 12/62* (2013.01); *H01R 13/447* (2013.01)

(58) Field of Classification Search

CPC ..... H01R 13/4538; H01R 13/447

USPC ..... 439/139, 140, 141

See application file for complete search history.

(56) References Cited

U.S. PATENT DOCUMENTS

| | | | | |
|---|---|---|---|---|
| 4,445,739 | A * | 5/1984 | Wooten | 439/140 |
| 4,843,226 | A * | 6/1989 | Kato et al. | 235/492 |
| 6,139,338 | A * | 10/2000 | Hirai | G06K 13/0887 439/141 |
| 6,231,361 | B1 | 5/2001 | Ko et al. | |
| 6,480,390 | B2 | 11/2002 | Matsumiya et al. | |
| 6,733,311 | B2 * | 5/2004 | Kameda | H01R 13/4538 439/140 |
| 6,866,535 | B2 * | 3/2005 | Uchida | H01R 13/6275 439/357 |
| 6,908,342 | B2 * | 6/2005 | Shimada | H01R 13/453 439/136 |
| 7,121,850 | B2 | 10/2006 | Yeh | |
| 7,850,468 | B2 | 12/2010 | Ni et al. | |
| 7,869,219 | B2 | 1/2011 | Ma et al. | |
| 8,116,083 | B2 | 2/2012 | Ni et al. | |
| 8,550,724 | B2 * | 10/2013 | Oki | 385/92 |
| 2006/0141865 | A1 * | 6/2006 | Su | H01R 27/00 439/607.01 |

(Continued)

*Primary Examiner* — Renee Luebke
*Assistant Examiner* — Paul Baillargeon

(57) ABSTRACT

Pluggable connector having a connector housing with a receiving space that opens to a leading end of the connector housing. The pluggable connector includes an edge interface that is positioned within the receiving space and has a mating edge. The pluggable connector also includes a guard assembly that is coupled to the connector housing and includes a front wall and a spring member that operably engages the front wall. The front wall has an edge slot. The spring member is biased to hold the front wall in a forward position with respect to the edge interface. The front wall compresses the spring member as the front wall moves from the forward position to a displaced position. The mating edge moves through the edge slot and clears the front wall as the front wall moves to the displaced position.

12 Claims, 7 Drawing Sheets

(56) References Cited

U.S. PATENT DOCUMENTS

2011/0143555 A1* 6/2011 Pan ..... H01R 13/5213
439/38

* cited by examiner

PLUGGABLE CONNECTOR HAVING A PROTECTIVE FRONT WALL

BACKGROUND

The subject matter herein relates generally to a pluggable connector having a card edge or similar interface that is received by a mating connector.

Pluggable cable assemblies may be used to transfer data to and from different communication systems or devices. Known cable assemblies may include a pluggable connector having a leading end and a trailing end and a communication cable that is coupled to the trailing end. The leading end is inserted into a receptacle assembly of the communication system, and the trailing end is coupled to the cable. The cable may include insulated wires that transmit electrical signals or optical fibers that transmit optical signals. The pluggable connector also includes a circuit board that has electrical contacts exposed along a card edge of the circuit board. The card edge is proximate to the leading end of the pluggable connector. For cable assemblies that transmit electrical signals, the wire conductors are terminated to electrical contacts of the circuit board. For cable assemblies that transmit optical signals, the cable assembly has an optical engine that is coupled to the circuit board and converts optical signals to electrical signals or vice versa. During a mating operation, the leading end of the pluggable connector is inserted into a cavity of the receptacle assembly. The electrical contacts along the card edge of the circuit board engage corresponding electrical contacts of a mating connector within the cavity of the receptacle assembly.

The conventional pluggable connector typically includes a connector housing with an opening at the leading end where a front portion of the circuit board is located. When the cable assembly is manufactured, shipped, or otherwise handled prior to the mating operation, the circuit board is at a greater risk of being damaged. Although the connector housing may surround and protect a majority of the circuit board, the front portion of the circuit board, which includes the card edge and the electrical contacts described above, is exposed through the opening of the connector housing. If an external object unintentionally passes through the opening, the object may damage the front portion of the circuit board.

Accordingly, there is a need for a pluggable connector that protects the front portion of the circuit board (or a similar interface) from being damaged by external objects.

BRIEF DESCRIPTION

In an embodiment, a pluggable connector is provided that includes a connector housing having a leading end, a trailing end, and a central axis that extends between the leading and trailing ends. The connector housing has a receiving space that opens to the leading end. The pluggable connector also includes a card assembly that is held by the connector housing and includes an edge interface configured to communicatively engage a mating connector. The edge interface is positioned within the receiving space and has a mating edge that extends transverse to the central axis. The pluggable connector also includes a guard assembly that is movably coupled to the connector housing and includes a front wall and a spring member that operably engages the front wall. The front wall extends generally transverse to the central axis and has an edge slot. The spring member biases the front wall to a forward position with respect to the edge interface, wherein the front wall compresses the spring member as the front wall is moved from the forward position to a displaced position. The mating edge moves through the edge slot and clears the front wall as the front wall moves to the displaced position.

In certain embodiments, the edge interface may have an exposed perimeter that includes the mating edge and that also includes opposite side edges that extend parallel to the central axis. The guard assembly may include a protective shroud that has the front wall. The protective shroud may surround the edge interface when the front wall is in the forward position to protect the edge interface.

In an embodiment, a pluggable connector is provided that includes a connector housing having a leading end that is configured to be inserted into a receptacle assembly. The connector housing includes a receiving space at the leading end that opens in multiple directions to an exterior of the connector housing. The pluggable connector also includes a card assembly that is held by the connector housing and includes an edge interface configured to communicatively engage a mating connector of the receptacle assembly. The edge interface is positioned within the receiving space. The pluggable connector also includes a guard assembly that is movably coupled to the connector housing and includes a protective shroud and a spring member that operably engages the protective shroud. The protective shroud has an edge slot. The spring member biases the protective shroud to a forward position in which the protective shroud substantially surrounds the receiving space and encloses the edge interface therein. The protective shroud compresses the spring member during a mating operation as the protective shroud moves from the forward position to a displaced position. The mating edge moves through the edge slot and clears the protective shroud as the protective shroud moves to the displaced position.

DETAILED DESCRIPTION

Figure 1:
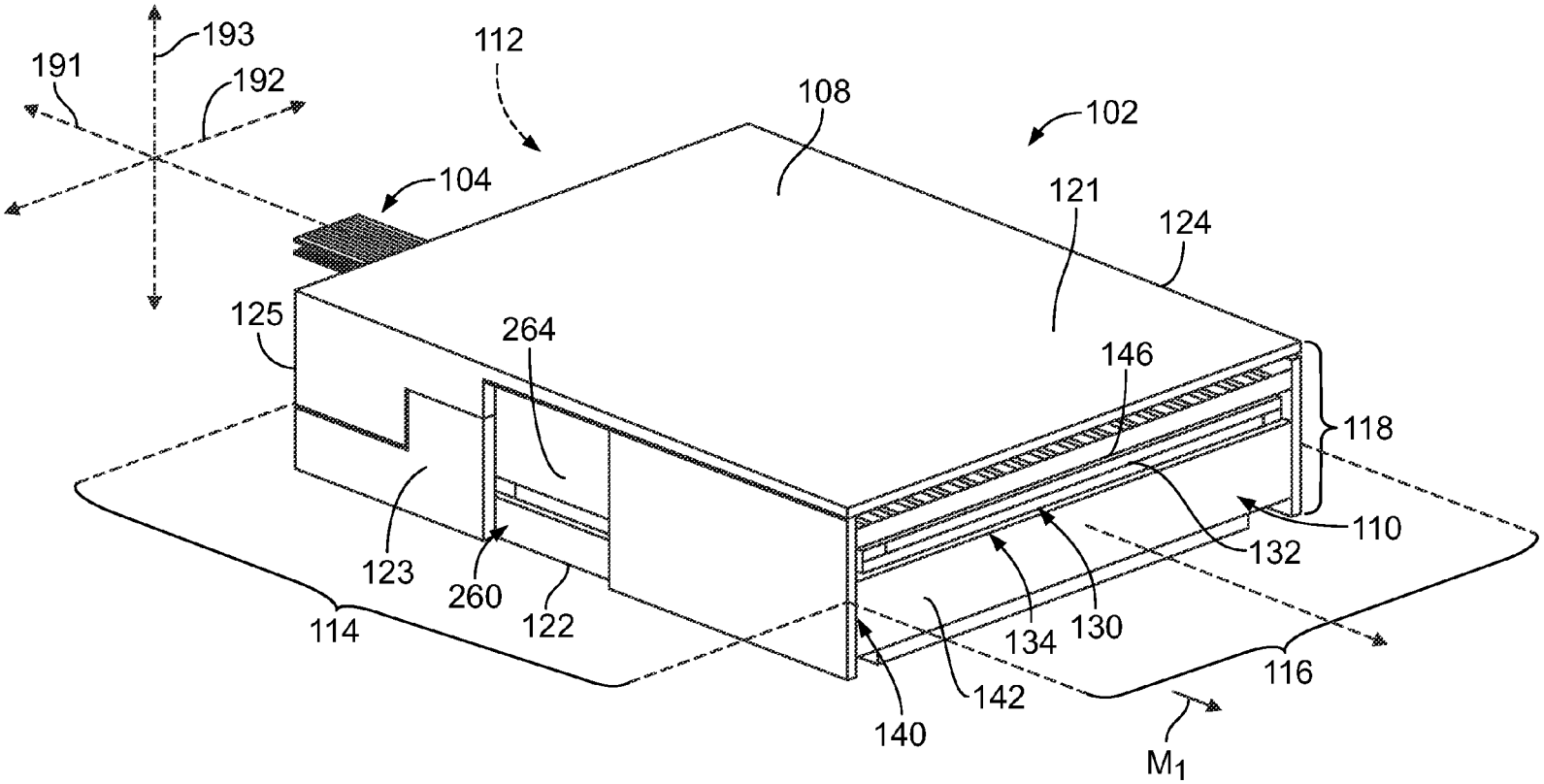
FIG. 1 is a perspective view of a cable assembly that includes a pluggable connector formed in accordance with an embodiment.

FIG. 1 is a perspective view of a cable assembly 100 formed in accordance with an embodiment. The cable assembly 100 includes a pluggable connector 102 and a communication cable 104 that is operably coupled to the pluggable connector 102. The pluggable connector 102 is configured to be inserted into a receptacle assembly 106 (shown in FIGS. 14-16) during a mating operation. The pluggable connector 102 is oriented with respect to mutually perpendicular axes 191, 192, 193, which include a central axis 191, a lateral axis 192, and an elevation axis 193. In some embodiments, the elevation axis 193 may extend parallel to the force of gravity, but it should be understood that embodiments are not required to have any particular orientation with respect to gravity.

The pluggable connector 102 includes a connector housing 108 that has a leading end 110 and a trailing end 112. The leading end 110 is configured to mate with or otherwise engage the receptacle assembly 106 (FIGS. 14-16) during the mating operation. In the illustrated embodiment, the trailing end 112 has the communication cable 104 coupled thereto. The communication cable 104 may be permanently attached to the pluggable connector 102 or separably attached to the pluggable connector 102. In the illustrated embodiment, the communication cable 104 includes one or more optical fibers that are configured to transfer data signals to the pluggable connector 102 and/or from the pluggable connector 102. The data signals are in the form of optical signals. In alternative embodiments, the communication cables include insulated wires having jackets that surround wire conductors. The wire conductors may be configured to transfer electrical signals and/or electrical power.

As shown, the central axis 191 extends through an approximate center of the pluggable connector 102 between the leading end 110 and the trailing end 112. The leading end 110 and the trailing end 112 face in opposite directions along the central axis 191. During the mating operation, the leading end 110 is advanced in a mating direction $M_1$ that extends parallel to or coincides with the central axis 191. The leading end 110 may be received by the receptacle assembly 106.

The connector housing 108 has a length 114 that extends along the central axis 191, a width 116 that extends along the lateral axis 192, and a height 118 that extends along the elevation axis 193. In the illustrated embodiment, the length 114 is greater than the width 116. The pluggable connector 102, however, may have other configurations. For example, the width 116 may be greater than length 114 in other embodiments.

Also shown in FIG. 1, the connector housing 108 includes a plurality of exterior housing sides 121, 122, 123, 124, and 125, which include a first or top body side 121, a second or bottom body side 122, opposite side walls 123, 124, and a back wall 125. The side walls 123, 124 face in opposite directions along the lateral axis 192 and extend between the first and second body sides 121, 122. The first and second body sides 121, 122 face in opposite directions along the elevation axis 193 and extend laterally between the side walls 123, 124. The connector housing 108 includes a housing cavity 130 and is configured to hold a card assembly 132 within the housing cavity 130. The housing cavity 130 includes a receiving space 134 that is located between the first and second body sides 121, 122 proximate to the leading end 110. The receiving space 134 is shown more clearly in FIG. 4. As used herein, the phrase "proximate to the leading end" includes being located at the leading end.

Figure 14:
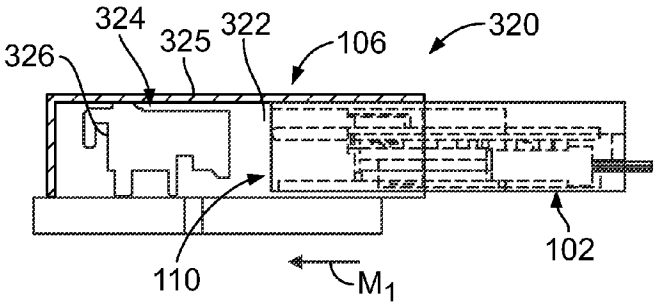
FIG. 14 is a side cross-section of a communication system that includes the pluggable connector of FIG. 1 and a receptacle assembly that receives the pluggable connector during a mating operation.
Figure 15:
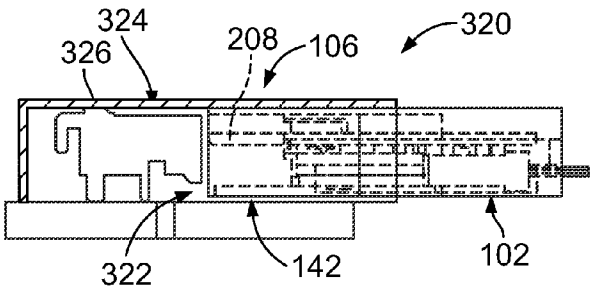
FIG. 15 is a side cross-section of the communication system with the protective shroud of the pluggable connector of FIG. 1 in a forward position and engaging a mating connector.
Figure 16:
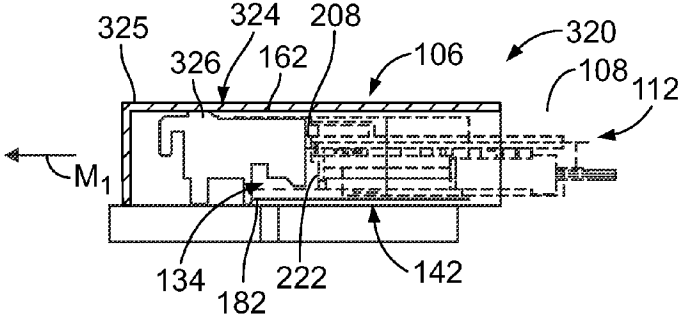
FIG. 16 is a side cross-section of the communication system with the protective shroud of the pluggable connector of FIG. 1 in a displaced position.

The pluggable connector 102 includes a guard assembly 140 that is coupled to the connector housing 108. Prior to the mating operation, the guard assembly 140 is configured to protect or shield the card assembly 132. To this end, the guard assembly 140 includes a protective shroud 142 and a spring member 144 (shown in FIGS. 8 and 9). The protective shroud 142 is held proximate to the leading end 110 by the spring member 144 when the pluggable connector 102 is unmated with respect to the receptacle assembly 106 (FIGS. 14-16). The protective shroud 142, however, is permitted to move through the receiving space 134 during the mating operation.

Figure 9:
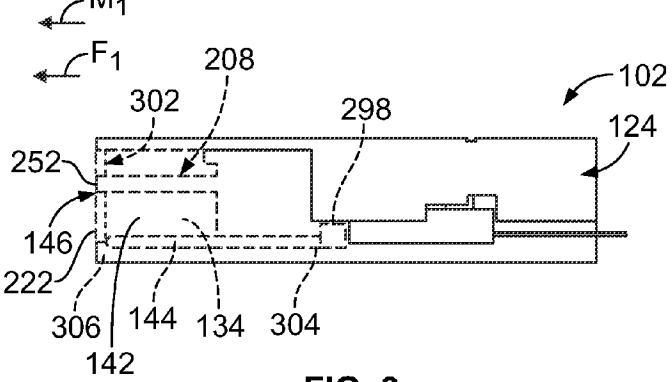
FIG. 9 is a side view of the pluggable connector illustrating the spring member in the expanded condition.

For example, the spring member 144 may be predisposed to hold the protective shroud 142 in a forward position proximate to the leading end 110 when the pluggable connector 102 is unmated with respect to the receptacle assembly 106. The forward position of the protective shroud 142 is shown in FIG. 1. Although the spring member 144 biases the protective shroud 142 to the forward position, the spring member 144 permits the protective shroud 142 to be deflected and moved toward the trailing end 112 to a displaced position, which is shown in FIG. 9, during the mating operation. More specifically, when the pluggable connector 102 is unmated with respect to the receptacle assembly 106, the spring member 144 biases the protective shroud 142 to the forward position such that the card assembly 132 is protected by the protective shroud 142 from external objects. As the pluggable connector 102 is mated with the receptacle assembly 106, however, the protective shroud 142 is engaged and deflected by a portion of the receptacle assembly 106 while a remainder of the pluggable connector 102 continues moving further in mating direction $M_1$. As such, the protective shroud 142 compresses the spring member 144 and moves closer to the trailing end 112. When the protective shroud 142 is in the displaced position, the card assembly 132 projects through an edge slot 146 of the protective shroud 142 and communicatively engages the receptacle assembly 106. As the pluggable connector 102 is removed from the receptacle assembly 106, the spring member 144 may return the protective shroud 142 back to the forward position.

In some embodiments, the pluggable connector 102 may be an input/output (I/O) module that is capable of being repeatedly inserted into and removed from a receptacle assembly. The pluggable connector 102 may be configured for various applications. Non-limiting examples of such applications include host bus adapters (HBAs), redundant arrays of inexpensive disks (RAIDs), workstations, rack-mount servers, servers, storage racks, high performance computers, or switches. The pluggable connector 102 may be configured for one or more industry standards, such as IEEE 802.3ba, and be capable of transmitting six (6) gigabits per second (Gbps) for each lane or 10 Gbps per lane. In particular embodiments, the pluggable connector 102 may be part of a C form-factor pluggable (CFP) interface that is configured to transmit high speed data signals, such as 40 Gbps, 100 Gbps, or more. In other embodiments, the pluggable connector 102 may be configured to be compliant with small form factor (SFF) industry standards, such as SFF-8644 or SFF-8449 HD. Although the pluggable connector 102 may be a high-speed connector in some embodiments, the pluggable connector 102 may transmit at slower transmission speeds or data rates. Moreover, the pluggable connector 102 is not limited to data transmission applications, but may also be used to transmit electrical power.

Figure 2:
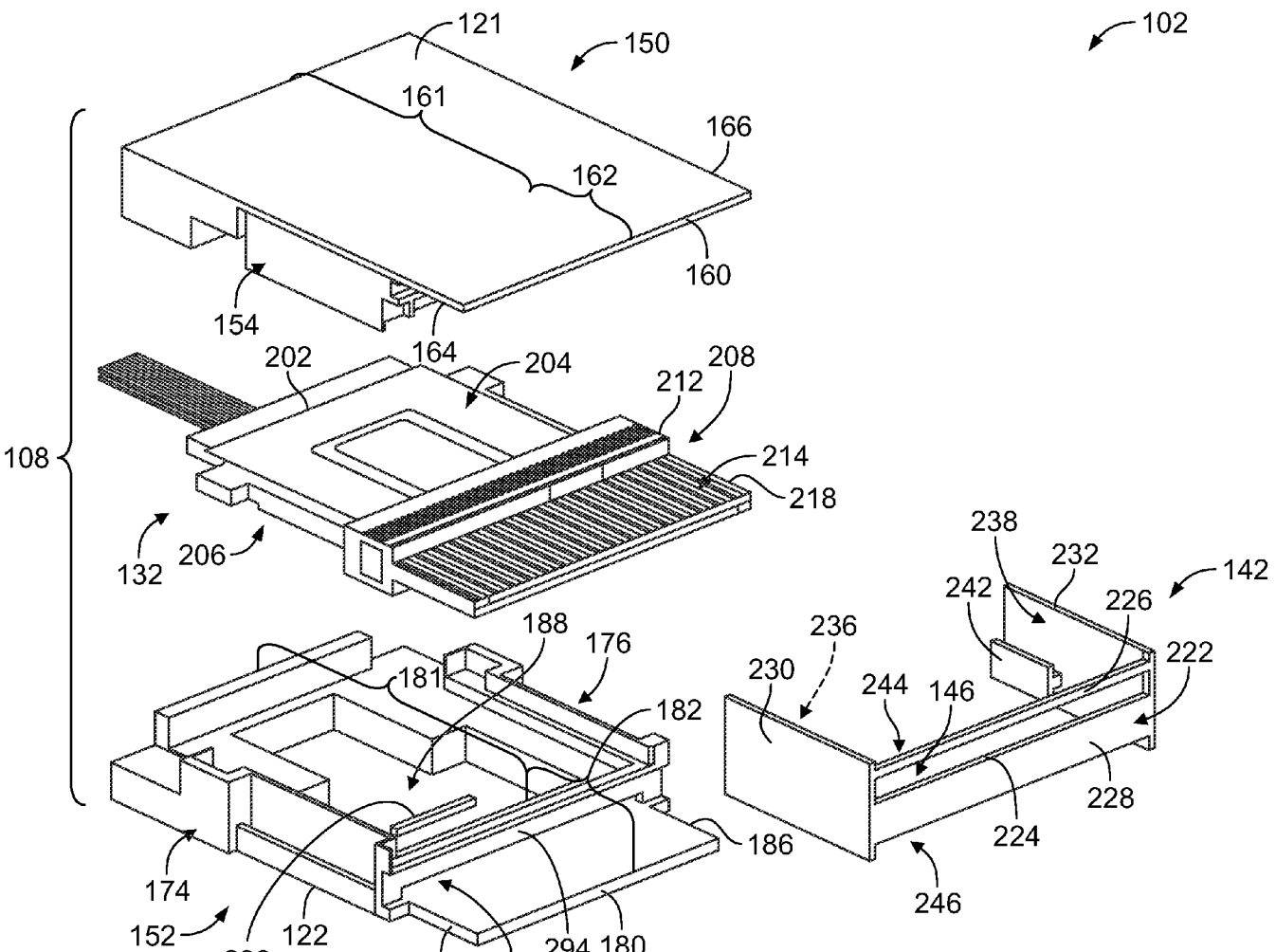
FIG. 2 is a partially exploded view of the pluggable connector of FIG. 1 in accordance with an embodiment.

FIG. 2 is a partially exploded view of the pluggable connector 102. In the illustrated embodiment, the connector housing 108 includes first and second housing shells 150, 152. The housing shells 150, 152 are sized and shaped in a complementary manner such that the connector housing 108 is formed when the housing shells 150, 152 are combined. The housing shell 150 includes a wall section 154 and a laterally opposite wall section 156 (shown in FIG. 4). The first body side 121 extends laterally between the wall sections 154, 156. The housing shell 150 includes a front edge 160 that is positioned at the leading end 110 (FIG. 1) when the pluggable connector 102 is fully assembled. In particular embodiments, the housing shell 150 also includes a base portion 161 and a housing extension 162. The base portion 161 may include the wall sections 154, 156 and generally interface with the card assembly 132 when the pluggable connector 102 is assembled. The housing extension 162 extends from the base portion 161 to the front edge 160. The housing extension 162 also includes opposite lateral edges 164, 166. The front edge 160 is coupled to and extends between the lateral edges 164, 166.

In a similar manner, the housing shell 152 includes a wall section 174 and a laterally opposite wall section 176. The second body side 122 extends laterally between the wall sections 174, 176. The housing shell 152 defines a front edge 180 that is positioned at the leading end 110 (FIG. 1) when the pluggable connector 102 is fully assembled. In particular embodiments, the second housing shell 152 also includes a base portion 181 and a housing extension 182. The base portion 181 may include the wall sections 174, 176 and generally interface with the card assembly 132 when the pluggable connector 102 is fully assembled. The housing extension 182 extends from the base portion 181 to the front edge 180. The housing extension 182 also includes opposite lateral edges 184, 186. The front edge 180 is coupled to and extends between the lateral edges 184, 186.

When the first and second housing shells 150, 152 are coupled to each other, the housing cavity 130 (FIG. 1), including the receiving space 134 (FIG. 4), is defined therebetween. In certain embodiments, the receiving space 134 is defined between the housing extensions 162, 182. The housing cavity 130 may be formed from corresponding cavity portions or recesses 188 of the housing shells 150, 152. The cavity portion 188 of the housing shell 152 is shown in FIG. 2. When the housing shells 150, 152 are coupled to each other, the cavity portions 188 are combined to form the housing cavity 130. The housing cavity 130 is sized and shaped to hold the card assembly 132 therein.

Also shown in FIG. 2, the housing shell 152 may include a forward-facing wall 294 that includes a spring window 296. The spring window 296 extends laterally across the housing shell 152. The housing shell 152 may also include a spring base 298 located within the cavity portion 188. As described in greater detail below, the spring member 144 (FIGS. 8 and 9) is configured to be positioned within the cavity portion 188 against the spring base 298 and extend through the spring window 296 to engage the protective shroud 142. In alternative embodiments, the forward-facing wall 294 does not include the spring window 296. In such embodiments, the spring member 144 may directly engage the forward-facing wall 294.

Figure 3:
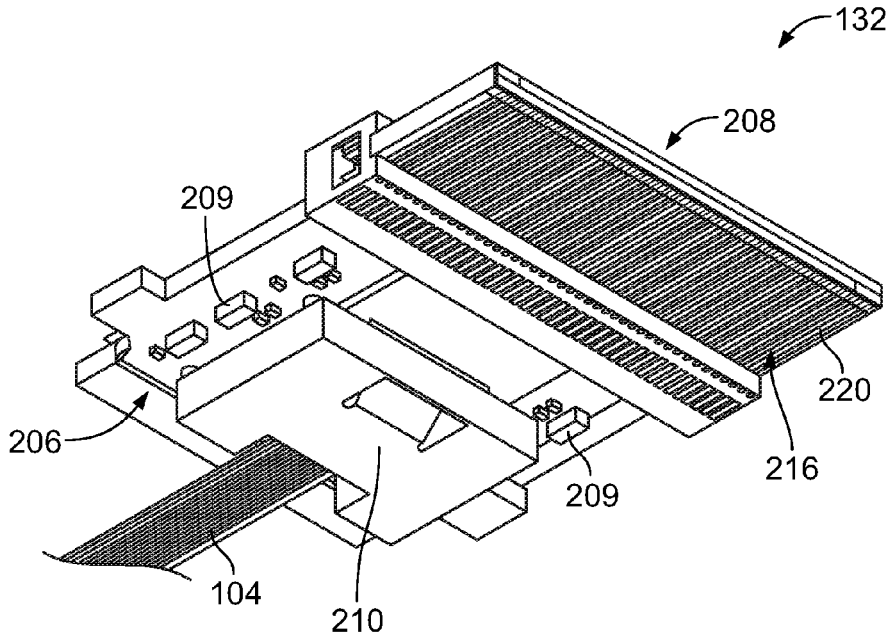
FIG. 3 is a bottom perspective view of a card assembly that may be used with the pluggable connector of FIG. 1.

In the illustrated embodiment, the card assembly 132 includes a board substrate 202 having opposite substrate sides 204, 206 and various communication components that are coupled to the board substrate 202 and operably interconnected to one another. To this end, the board substrate 202 may constitute or be part of a circuit board that includes conductive pathways for interconnecting the communication components. For example, the communication components may include an edge interface 208, one or more processing units 209 (shown in FIG. 3), and an optical engine 210 (shown in FIG. 3). In the illustrated embodiment, the edge interface 208 includes a plug housing 212 and a row 214 of electrical contacts 218 that are coupled to the plug housing 212 along the substrate side 204. The row 214 of the electrical contacts 218 extends transverse to the central axis 191 (FIG. 1) or parallel to the lateral axis 192 (FIG. 1). As shown in FIG. 3, the edge interface 208 may also include a row 216 of electrical contacts 220 that are coupled to the plug housing 212 along the substrate side 206.

With respect to FIG. 2, the plug housing 212 may be straddle-mounted to the board substrate 202 such that the plug housing 212 engages each of the substrate sides 204, 206. An edge interface or straddle mount connector that may be similar or identical to the edge interface 208 is described in greater detail in U.S. patent application Ser. No. 14/266,761 ("the '761 Application") and was filed on the same day as the present application. The '761 Application is incorporated herein by reference in its entirety. In other embodiments, however, the edge interface does not include a plug housing. For example, the edge interface may be part of a circuit board having contact pads located along a mating edge of the circuit board. Such an embodiment is shown and described with respect to FIG. 17.

In the illustrated embodiment, the protective shroud 142 includes a front wall 222 having the edge slot 146. The front wall 222 may include an inner edge 224 that defines the edge slot 146. In particular embodiments, the edge slot 146 may be a narrow opening that is defined between a first wall portion 226 and a second wall portion 228. In alternative embodiments, the edge slot 146 may be open-sided. For example, in one alternative embodiment, the first wall portion 226 may be removed such that the edge slot is defined above the wall portion 228.

Figure 4:
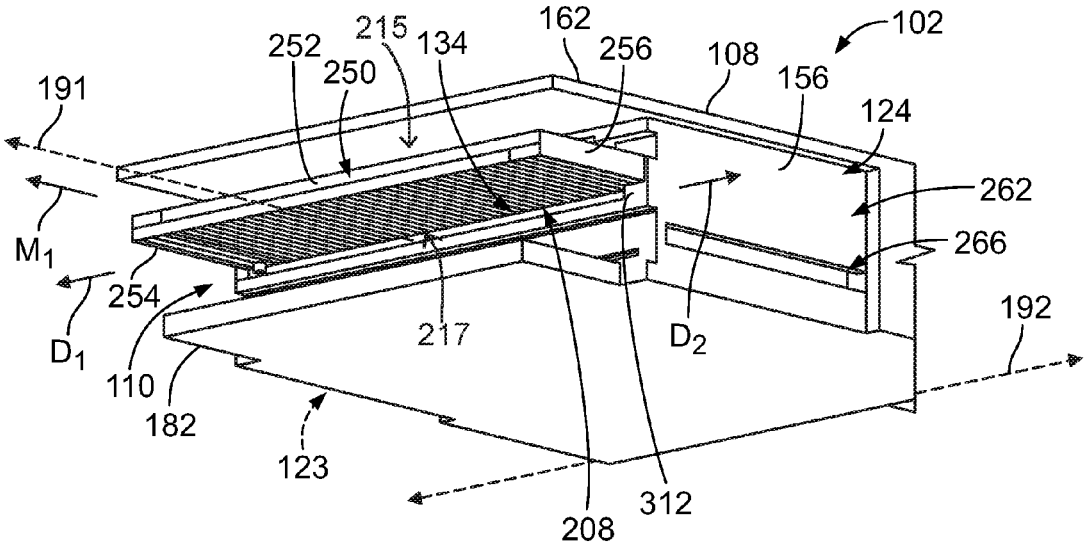
FIG. 4 illustrates the pluggable connector of FIG. 1 without a protective shroud positioned at an end of the pluggable connector.

The first and second wall portions 226, 228 may be shaped and/or positioned relative to the housing extensions 162, 182, respectively, such that the front wall 222 is permitted to slide between the body sides 121, 122 within the receiving space 134 (FIG. 4). In the illustrated embodiment, the front wall 222 includes a first extension recess 244 along the first wall portion 226 and a second extension recess 246 along the second wall portion 228. The housing extensions 162, 182 are configured to slide through the extension recesses 244, 246, respectively, along the first and second wall portions 226, 228, respectively, during the mating operation.

In certain embodiments, the protective shroud 142 is configured to surround the receiving space 134 (FIG. 4) or wrap about the leading end 110 (FIG. 1). Accordingly, the protective shroud 142 may include shroud sides 230, 232. The front wall 222 is coupled to and extends between the shroud sides 230, 232. When the pluggable connector 102 is fully assembled, the shroud sides 230, 232 may extend substantially parallel to the central axis 191 (FIG. 1). The shroud sides 230, 232 have inner side surfaces 236, 238, respectively, that oppose each other. In particular embodiments, the shroud side 232 includes a corresponding runner 242 along the inner side surface 238, and the shroud side 230 includes a corresponding runner 240 (shown in FIG. 7) along the inner side surface 236. The runners 240, 242 are configured to engage the connector housing 108 to guide the protective shroud 142 or the front wall 222 along a designated path. The runners 240, 242 have fixed positions with respect to the front wall 222. In alternative embodiments, the shroud sides 230, 232 do not include runners. For instance, the shroud sides 230, 232 may be received within corresponding slots or tracks of the connector housing 108.

FIG. 3 is a bottom perspective view of the card assembly 132 that shows the substrate side 206 having the optical engine 210 and the processing units 209 coupled thereto. One or more of the processing units 209 may constitute chips or other circuitry that is capable of processing data signals to execute one or more functions of the pluggable connector 102 (FIG. 1). The optical engine 210 is coupled to the communication cable 104 and is configured to be positioned within the cavity portion 188 (FIG. 2) of the housing shell 152 (FIG. 2). The optical engine 210 may receive optical signals from the communication cable 104 and convert the optical signals to electrical signals that are then transmitted through the edge interface 208. The optical engine 210 may also receive electrical signals through the edge interface 208 and convert the electrical signals to optical signals that are then transmitted through the communication cable 104. One or more of the processing units 209 may be used to convert the signal form of the data signals and/or modify the data signals to improve signal integrity. The row 216 of electrical contacts 220 is also shown in FIG. 3.

FIG. 4 is an isolated perspective view of the pluggable connector 102 with the protective shroud 142 (FIG. 1) removed. The pluggable connector 102, as shown in FIG. 4 without the protective shroud 142, may resemble known pluggable connectors that have circuit boards with front portions exposed to an exterior of the pluggable connector. The receiving space 134 is defined between the housing extensions 162, 182. The receiving space 134 is open-sided at the leading end 110 such that the receiving space 134 opens in multiple directions to an exterior of the connector housing 108. More specifically, the receiving space 134 opens in the mating direction $M_1$, a first lateral direction $D_1$, and a second lateral direction $D_2$. The first and second lateral directions $D_1$, $D_2$ are opposite each other and extend parallel to the lateral axis 192. Accordingly, without the protective shroud 142 present, objects may enter the receiving space 134 in a direction along the central axis 191 or in a direction along the lateral axis 192.

The edge interface 208 has opposite interface sides 215, 217 and a mating edge 252 that joins the interface sides 215, 217. The edge interface 208 includes an exposed perimeter 250 that is positioned within the receiving space 134. The exposed perimeter 250 includes multiple edges of the edge interface 208 that join the interface sides 215, 217 and that extend in different directions. The exposed perimeter 250 may include the mating edge 252 and opposite side edges 254, 256 that are coupled to the mating edge 252. The mating edge 252 extends transverse to the central axis 191 (or parallel to the lateral axis 192) between the side edges 254, 256. Each of the side edges 254, 256 extends substantially parallel to the central axis 191. The mating edge 252 faces in the mating direction $M_1$, and the side edges 254, 256 face in the first and second lateral directions $D_1$, $D_2$. The mating and side edges 252, 254, and 256 face the exterior of the pluggable connector 102. Without the protective shroud 142 (FIG. 1), the mating and side edges 252, 254, 256 of the edge interface 208 have a greater risk of being damaged by external objects that enter the receiving space 134.

The side wall 124 includes a wall runway or recess 262, and the side wall 123 includes a wall runway or recess 260 (FIG. 1). The wall runways 260, 262 are sized and shaped to receive the shroud sides 230, 232, respectively, which are shown in FIG. 2. In some embodiments, the side walls 123, 124 may also include shroud tracks 264 (FIG. 1), 266, respectively. The shroud tracks 264, 266 are configured to slidably engage the protective shroud 142 to guide the protective shroud 142 along a designated path between the forward position (FIGS. 1 and 11) and the displaced position (FIG. 12).

Figure 7:
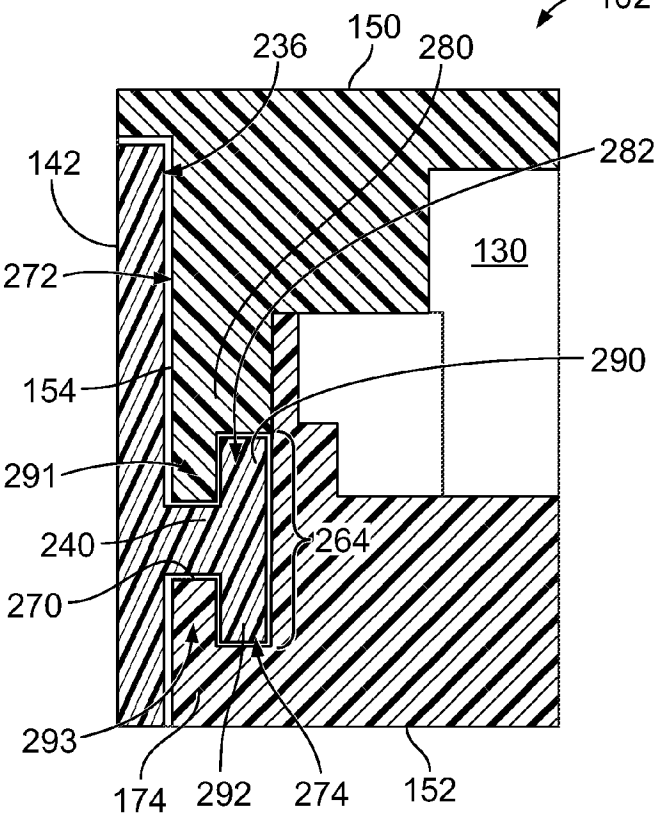
FIG. 7 is a cross-section of the pluggable connector in which the protective shroud is slidably coupled to the housing shells of FIGS. 5 and 6.
Figure 5:
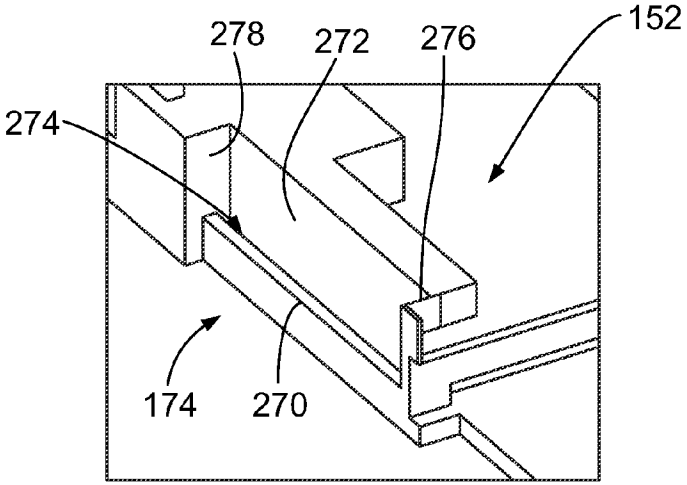
FIG. 5 is an enlarged perspective view a housing shell that may be used by the pluggable connector of FIG. 1.
Figure 6:
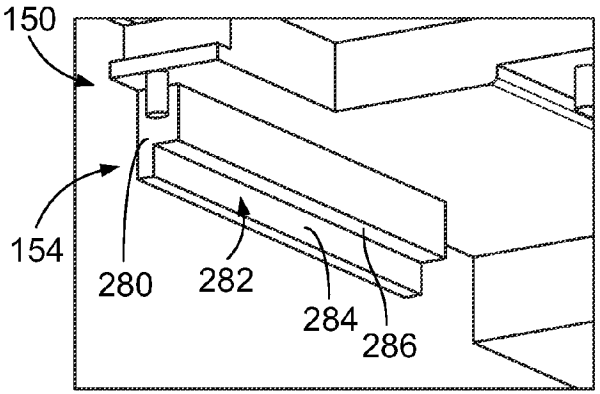
FIG. 6 is an enlarged perspective view of another housing shell that may couple to the housing shell of FIG. 5.

FIGS. 5-7 illustrate one mechanism for guiding the protective shroud 142 (FIG. 7) between the forward and displaced positions. FIG. 5 is an enlarged perspective view of the housing shell 152. The wall section 174 includes a raised edge 270 and an outer wall surface 272. The outer wall surface 272 is separated from the raised edge 270 to define an elongated slot or channel 274 therebetween. The elongated slot 274 extends longitudinally along the central axis 191 (FIG. 1) between a first stop surface 276 and a second stop surface 278.

FIG. 6 is an enlarged perspective view of the housing shell 150. The wall section 154 is configured to mate with the wall section 174 (FIG. 2) to form at least a portion of the side wall 123 (FIG. 1). The wall section 154 includes a wall tab 280 that forms an elongated recess 282 defined by first and second tab surfaces 284, 286. The first and second tab surfaces 284, 286 are perpendicular to each other. The elongated recess 282 extends parallel to the central axis 191 (FIG. 1). The wall tab 280 and/or the elongated recess 282 may have a length that is substantially equal to a length of the elongated slot 274 (FIG. 5).

FIG. 7 is an enlarged cross-sectional view of the pluggable connector 102 showing the wall sections 154, 174 mated together to form the shroud track 264. The shroud track 264 has the runner 240 of the protective shroud 142 located therein. The runner 240 is slidably engaged to surfaces of the housing shells 150, 152 that form the shroud track 264. In certain embodiments, the runner 240 may be substantially T-shaped such that the runner 240 includes opposite projections 290, 292 that are spaced apart from the inner side surface 236 to form gaps 291, 293, respectively. When the pluggable connector 102 is assembled, the projection 292 may be inserted into the elongated slot 274 such that the gap 293 receives the raised edge 270. The housing shells 150, 152 and the protective shroud 142 may be coupled to one another such that the outer wall surface 272 directly engages the inner side surface 236 of the protective shroud 142, and the gap 291 receives a portion of the wall tab 280. Accordingly, the elongated recess 282 and the elongated slot 274 are combined to form the shroud track 264. A length or distance of the shroud track 264 along the central axis 191 (FIG. 1) may be defined between the stop surfaces 276, 278 (FIG. 5). When the housing shells 150, 152 are coupled to each other, the housing cavity 130 is also defined therebetween.

It should be understood that the shroud track 264 may be formed in other manners. For example, in alternative embodiments, the housing shell 152 may include the wall tab 280 and the housing shell 152 may include the elongated slot 274. Furthermore, the housing shell 150 may include the stop surfaces 276, 278 (FIG. 5). In other embodiments, only one of the housing shells 150, 152 may define the shroud track 264. In other embodiments, the runner 240 may be L-shaped.

Figure 8:
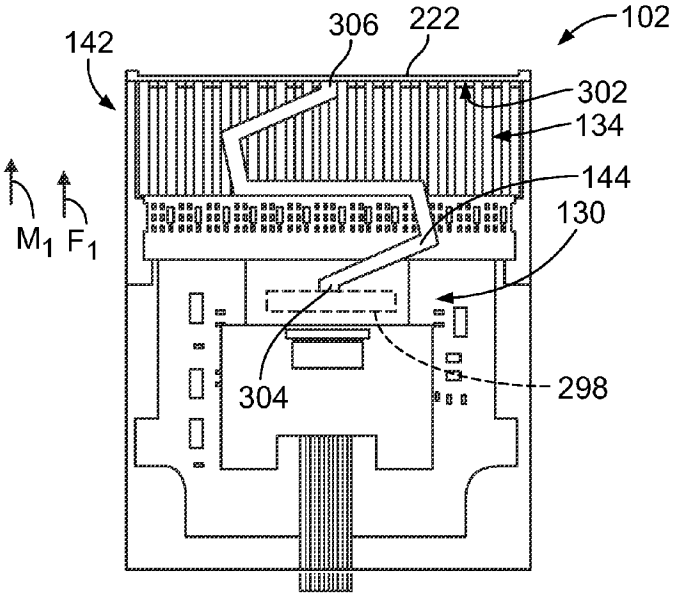
FIG. 8 is a plan view of an underside of the pluggable connector illustrating a spring member having an expanded condition.

FIGS. 8-11 illustrate spring members that may be used by embodiments set forth herein. FIG. 8 is a plan view of an underside of the pluggable connector 102 with the housing shell 152 (FIG. 2) removed. FIG. 9 is a side view of the pluggable connector 102 showing the side wall 124. Portions of the pluggable connector 102 are shown in phantom in FIG. 9. The spring member 144 is disposed within the housing cavity 130 (FIG. 8) and the receiving space 134. The spring member 144 extends from the spring base 298 to an interior wall surface 302 of the front wall 222. Although the spring base 298 is part of the housing shell 152, which is not shown in FIG. 8, the spring base 298 is represented in FIG. 8 as a dashed box. The spring member 144 has a first end 304 that engages the spring base 298, and a second end 306 that engages the interior wall surface 302. When the pluggable connector 102 is fully assembled, the spring member 144 extends under the forward-facing wall 294 (FIG. 2) through the spring window 296 (FIG. 2).

In FIGS. 8 and 9, the spring member 144 is in an expanded state or condition such that the protective shroud 142 (or the front wall 222) is in the forward position. In the expanded state, the spring member 144 may generate a small biasing force $F_1$ in the mating direction $M_1$ to prevent the protective shroud 142 from inadvertently moving toward the displaced position. As the protective shroud 142 moves to the displaced position (shown in FIG. 12), the spring member 144 changes to a compressed state. In the compressed state, the biasing force $F_1$ may be greater than the biasing force $F_1$ in the expanded state. When the spring member 144 is permitted to move back to the expanded state, the biasing force $F_1$ is sufficient to move the protective shroud 142 in the mating direction $M_1$ to the forward position.

As shown in FIG. 8, the spring member 144 has an elongated body with a non-linear, wavy shape. The spring member 144, however, may have other configurations or be other types in alternative embodiments. For example, the spring member 144 may be a coil spring. In other embodiments, the spring member 144 may have a similar shape as the spring member 444 (shown in FIGS. 10 and 11). Yet in other embodiments, the spring member 144 may be a single finger that is capable of being resiliently deformed between expanded and compressed states. Moreover, although FIGS. 8 and 9 only show a single spring member 144, other embodiments may include more than one spring member of the same or different type.

As shown in FIG. 9, when the protective shroud 142 is in the forward position, the mating edge 252 or the edge interface 208 is substantially aligned with the edge slot 146. In some embodiments, the front wall 222 may coincide with the mating edge 252 such that the mating edge 252 is disposed within the edge slot 146. Nonetheless, the protective shroud 142 substantially surrounds the receiving space 134 and encloses the edge interface 208 therein. In other embodiments, the protective shroud 142 may be positioned in front of the mating edge 252 such that a separation distance exists generally between the front wall 222 and the mating edge 252.

Figure 10:
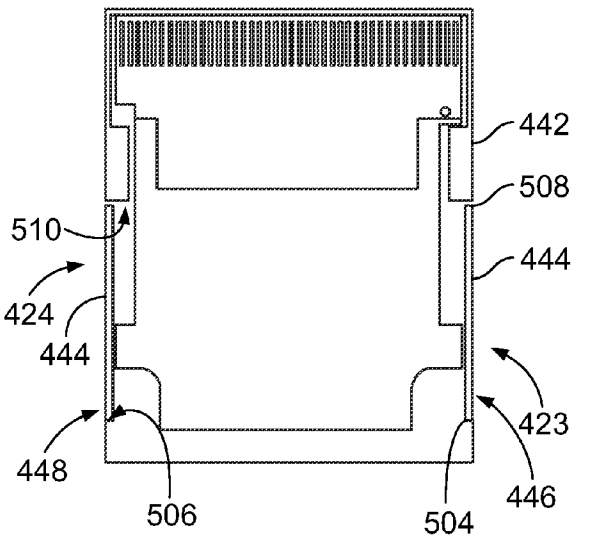
FIG. 10 is a plan view of a pluggable connector formed in accordance with an embodiment illustrating a pair of spring members in expanded conditions.
Figure 11:
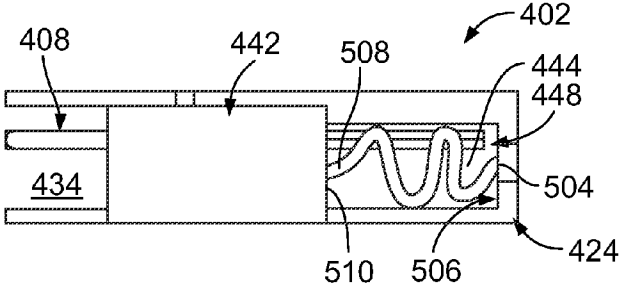
FIG. 11 is a side view of the pluggable connector of FIG. 10 illustrating one of the spring members in a compressed condition.
Figure 12:
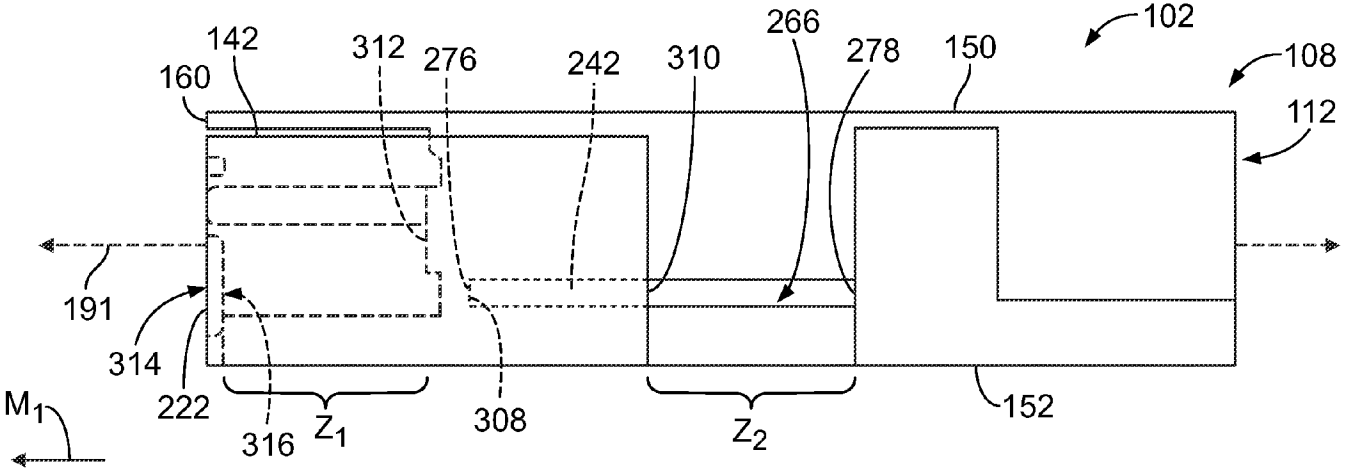
FIG. 12 is a side view of the pluggable connector of FIG. 1 when the protective shroud is in a forward position.

FIG. 10 is a plan view of a pluggable connector 402 formed in accordance with an embodiment, and FIG. 11 is a side view of the pluggable connector 402. The pluggable connector 402 may be similar to the pluggable connector 102 (FIG. 1). The pluggable connector 402 includes a pair of spring members 444 that are located within opposite wall runways 446, 448 of opposite side walls 423, 424, respectively. FIG. 11 shows only one of the spring members 444 within the wall runway 448 of the side wall 424. The spring members 444 have a first end 504 that engages a backstop 506 of the corresponding wall runway, and a second end 508 that engages an end wall 510 of a protective shroud 442.

In FIG. 10, the spring members 444 are in expanded states or conditions and the protective shroud 442 is in a forward position. In FIG. 11, the spring member 444 is in a compressed state. In the compressed state, the protective shroud 442 is in a displaced position. As shown, the pluggable connector 402 has an edge interface 408 that is located within a receiving space 434 for engaging a mating connector (not shown). In the illustrated embodiment, the spring members 444 have elongated bodies with serpentine shapes. The spring members 444, however, may have other configurations and types in alternative embodiments, such as those described above with respect to the spring member 144 (FIG. 8).

Figure 13:
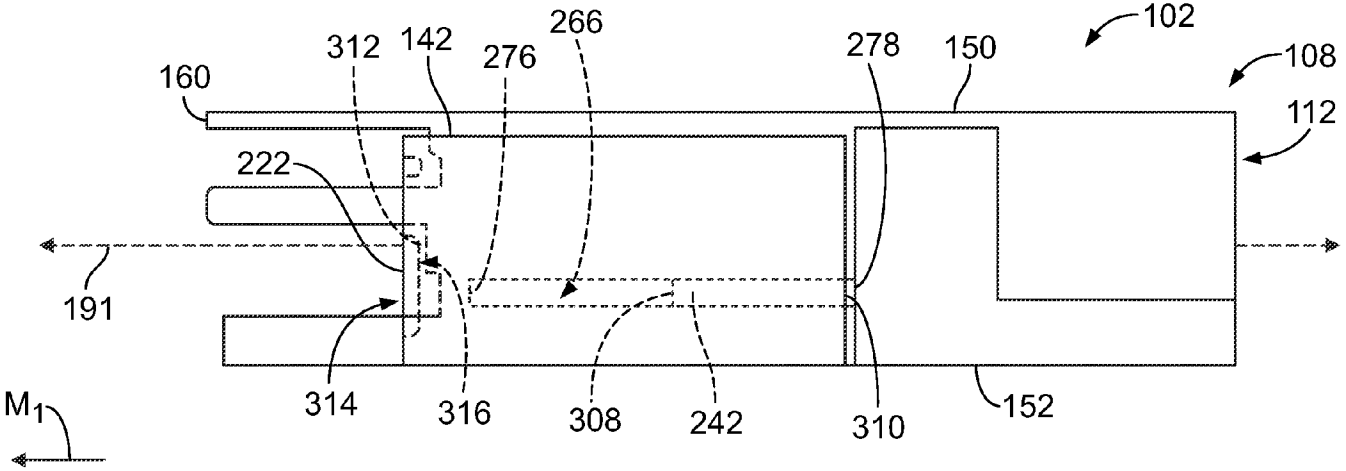
FIG. 13 is a side view of the pluggable connector of FIG. 1 when the protective shroud is in a displaced position.

FIG. 12 is a side view of the pluggable connector 102 in which the protective shroud 142 is in the forward position, and FIG. 13 is a side view of the pluggable connector 102 in which the protective shroud 142 is in the displaced position. Although the following is with respect to the shroud track 266, the shroud track 264 (FIG. 1) may operate in a similar or identical manner. As shown, the front wall 222 includes a forward wall surface 314 and an interior wall surface 316. The forward and interior wall surfaces 314, 316 face in opposite directions along the central axis 191 with the forward wall surface 314 facing in the mating direction $M_1$. Similar to the shroud track 264, the shroud track 266 is defined longitudinally between corresponding first and second stop surfaces 276, 278 of the connector housing 108.

In some embodiments, the protective shroud 142 includes a blocking surface that faces a stop surface of the connector housing 108 and engages the stop surface when the protective shroud 142 is held in the forward position. For example, the runner 242 includes a first blocking surface 308 and a second blocking surface 310 that face in opposite directions along the central axis 191. The first blocking surface 308 faces in the mating direction $M_1$ and may face the stop surface 276. As described above, the spring member 144 (FIG. 8) biases the protective shroud 142 in the forward position. When the protective shroud 142 is in the forward position, the spring member 144 biases the protective shroud 142 such that the first blocking surface 308 engages the first stop surface 276 as shown in FIG. 12. The first stop surface 276 prevents the protective shroud 142 from moving further in the mating direction $M_1$. As such, the spring member 144 holds the protective shroud 142 in the forward position.

As the protective shroud 142 moves to the displaced position, the runner 242 slides through the shroud track 266 along a predetermined path. The second blocking surface 310 moves closer to the second stop surface 278 as the first blocking surface 308 moves away from the first stop surface 276. The first blocking surface 308 and the first stop surface 276 are spaced apart when the protective shroud 142 is in the displaced position.

In alternative embodiments, the stop surface 276 of the connector housing 108 may have other locations. For example, the first housing shell 150 may include a lip or overhang (not shown) along the front edge 160 that engages a portion of the forward wall surface 314 of the front wall 222 when the protective shroud 142 is moved forward by the spring member 144 (FIG. 8).

In a similar manner, the protective shroud 142 and the connector housing 108 may have surfaces that limit movement of the protective shroud 142 toward the trailing end 112. For example, the connector housing 108 may include an internal shroud-blocking surface 312 that faces in the mating direction $M_1$. The shroud-blocking surface 312 is also shown in FIG. 4. In an exemplary embodiment, the interior wall surface 316 of the front wall 222 engages the shroud-blocking surface 312 prior to the second blocking surface 310 engaging the second stop surface 278. In other embodiments, the second stop surface 278 may engage the second blocking surface 310 thereby stopping the protective shroud 142. Accordingly, in some embodiments, the protective shroud 142 may move a path distance $Z_1$ (FIG. 12) that is defined between the interior wall surface 316 and the shroud-blocking surface 312 along the central axis 191. In other embodiments, the protective shroud 142 may move a path distance $Z_2$ (FIG. 12) that is defined as a distance between the second blocking surface 310 and the second stop surface 278 along the central axis 191.

Yet still in other embodiments, the connector housing 108 does not stop the protective shroud 142 from moving toward the trailing end 112. For example, the pluggable connector 102 may be fully mated with the receptacle assembly 106 (FIG. 12). While fully mated, the spring member 144 may hold the protective shroud 142 or the front wall 222 against a mating connector 324 (FIGS. 14-16) of the receptacle assembly 106. Even though the pluggable connector 102 is fully mated, the interior wall surface 316 may be spaced apart from the shroud-blocking surface 312 and the second blocking surface 310 may be spaced apart from the second stop surface 278. In other words, the protective shroud 142 may be capable of moving closer toward the trailing end 112 when the pluggable connector 102 and the receptacle assembly 106 are fully mated. The protective shroud 142 is held in the displaced position by the spring member 144 pressing the protective shroud 142 against the mating connector 324 within the receptacle assembly 106.

FIGS. 14-16 illustrate side cross-sectional views of a communication system 320 that includes the pluggable connector 102 and the receptacle assembly 106. FIG. 14-16 show different stages of a mating operation between the pluggable connector 102 and the receptacle assembly 106. With respect to FIG. 14, the receptacle assembly 106 includes a receptacle cage 325 that is configured to receive the leading end 110 of the pluggable connector 102. In FIG. 14, the pluggable connector 102 has been inserted into a receptacle cavity 322 of the receptacle cage 325 and is advancing in the mating direction $M_1$ toward a mating connector 324. The mating connector 324 includes a connector housing 326.

FIG. 15 shows the pluggable connector 102 as the protective shroud 142 engages the connector housing 326 of the mating connector 324 within the receptacle cavity 322. The protective shroud 142 is in the forward position in FIG. 15 and substantially surrounds the edge interface 208. With respect to FIG. 16, after the protective shroud 142 or front wall 222 engages the connector housing 326, the protective shroud 142 remains stationary with respect to the mating connector 324 while a remainder of the pluggable connector 102 continues to move in the mating direction $M_1$. For instance, the connector housing 108 continues to advance in the mating direction $M_1$ such that the protective shroud 142 becomes closer to the trailing end 112. The protective shroud 142 moves relative to the edge interface 208. In such embodiments, the protective shroud 142 may be described as moving toward the displaced position. As the protective shroud 142 moves toward the displaced position, the front wall 222 and the spring base 298 (FIG. 2) compress the spring member 144 (FIG. 8). Also shown, the housing extensions 162, 182 of the connector housing 108 may slide over and under, respectively, the mating connector 324 as the connector housing 108 moves in the mating direction $M_1$.

The edge interface 208 has a fixed position with respect to the connector housing 108. Thus, as the connector housing 108 moves in the mating direction $M_1$, the edge interface 208 also moves in the mating direction $M_1$. More specifically, the mating edge 252 (FIG. 4) moves through the edge slot 146 (FIG. 1) and clears the front wall 222 of the protective shroud 142 as the protective shroud 142 moves from the forward position (FIG. 15) to the displaced position (FIG. 16). The edge interface 208 is then inserted into a receiving slot (not shown) of the mating connector 324. The mating connector 324 may have electrical contacts (not shown) that engage and electrically couple to the electrical contacts 218 (FIG. 2), 220 (FIG. 3) of the edge interface 208. When the protective shroud 142 is in the displaced position, the protective shroud 142 does not enclose the receiving space 134 and the edge interface 208. Instead, the edge interface 208 projects beyond the front wall 222 and is inserted into the mating connector 324. When the protective shroud 142 is in the displaced position, the mating connector 324 is located within the receiving space 134.

To unmate the pluggable connector 102 and the receptacle assembly 106, the pluggable connector 102 may be pulled in a direction that is opposite the mating direction $M_1$ and removed from the receptacle assembly 106. As the pluggable connector 102 is being withdrawn, the spring member 144 (FIG. 8) presses the protective shroud 142 against the mating connector 324 such that the protective shroud 142 initially remains stationary as the trailing end 112 moves away from the protective shroud 142. The protective shroud 142 remains stationary until the stop surface 276 (FIG. 5) engages the runner 240 (FIG. 7), whereupon the protective shroud 142 begins to move along with the pluggable connector 102. When the pluggable connector 102 is fully withdrawn, the protective shroud 142 has returned to the forward position.

In the illustrated embodiment, the protective shroud 142 is moved when the front wall 222 engages the mating connector 324. In other embodiments, the protective shroud 142 may engage an element within the cavity 322 (FIG. 14) before the protective shroud 142 engages the mating connector 324. For example, the cage 325 of the receptacle assembly 106 may include a tab (not shown) that projects into the cavity 322 and engages the protective shroud 142.

Embodiments set forth herein may include a protective shroud that partially extends or wraps about a leading end of the connector housing. For example, the shroud sides 230, 232 (FIG. 2) of the protective shroud 142 extend parallel to the central axis 191 (FIG. 1) and the front wall 222 extends transverse to the central axis 191 between the shroud sides 230, 232. Other embodiments may only include a front wall without the shroud sides. Optionally, the connector housing 108 may only open in one direction at the leading end for such embodiments.

Figure 17:
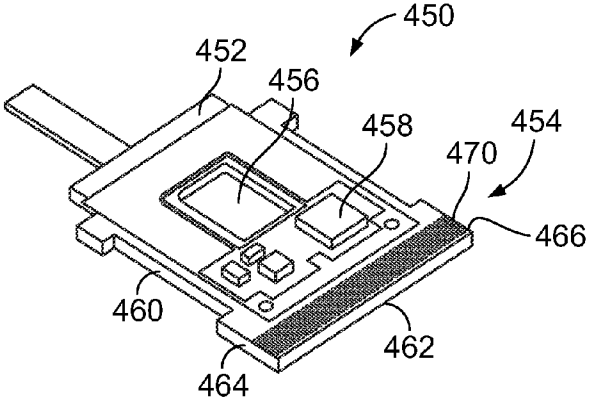
FIG. 17 is an isolated perspective view of a card assembly that may be used with a pluggable connector in accordance with an embodiment.

FIG. 17 is an isolated perspective view of a card assembly 450 that may be used with a pluggable connector (not shown) in accordance with an embodiment. The pluggable connector may be similar to the pluggable connector 102 (FIG. 1) and have a connector housing, such as the connector housing 108 (FIG. 1), that holds the card assembly 450. In the illustrated embodiment, the card assembly 450 includes a board substrate 452 and an edge interface 454. In some embodiments, the card assembly 450 may include an optical engine 456 and one or more processing units 458. The optical engine 456 and the processing units 458 may be similar or identical to the optical engine 210 and processing units 209 described above with respect to FIG. 3. In particular embodiments, the board substrate 452 and the edge interface 454 are parts of a circuit board 460. The circuit board 460 includes a mating edge 462 and opposite side edges 464, 466. The edge interface 454 includes the mating edge 462, the side edges 464, 466, and electrical contacts 470 that are positioned along the mating edge 462. Unlike the edge interface 208 (FIG. 2), which includes the plug housing 212 (FIG. 2), the edge interface 454 does not include a separate plug housing and, instead, constitutes a front portion of the circuit board 460. In such embodiments, the edge interface 454 may provide a more direct interconnection between the optical engine 456 and the mating connector (not shown).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a connector housing having a leading end, a trailing end, and a central axis that extends between the leading and trailing ends, the connector housing having a receiving space that opens to the leading end;

a card assembly held by the connector housing and comprising a card-shaped edge interface that is configured to be inserted into a receiving slot of a mating connector, the edge interface positioned within the receiving space and having opposite interface sides and a mating edge that joins the interface sides, the mating edge extending along and parallel to a lateral axis, at least one of the interface sides including a row of electrical contacts that extends transverse to the central axis and parallel to the lateral axis; and a guard assembly movably coupled to the connector housing and comprising a front wall and a spring member that operably engages the front wall, the front wall extending generally transverse to the central axis and having an edge slot, the spring member biasing the front wall to a forward position with respect to the edge interface, wherein the front wall compresses the spring member as the front wall is moved from the forward position to a displaced position, the mating edge moving through the edge slot and clearing the front wall as the front wall moves to the displaced position to expose the row of electrical contacts along the at least one interface side, wherein the connector housing includes first and second body sidewalls having respective wall surfaces that oppose each other and define the receiving space therebetween, each of the wall surfaces opposing one of the interface sides, the front wall being slidable along the central axis between the wall surfaces of the first and second body sidewalls and through the receiving space;

wherein the guard assembly includes a protective shroud that has the front wall and first and second shroud sides that are coupled to the front wall, the first and second shroud sides extending along the central axis away from the front wall, the first and second shroud sides opposing each other and being separated by the front wall, wherein the receiving space and the edge interface are disposed between the first and second shroud sides when the protective shroud is in the forward position, wherein the connector housing is disposed between the first and second shroud sides when the protective shroud is in the displaced position and the edge interface is exposed to an exterior of the pluggable connector in either direction along the lateral axis when the protective shroud is in the displaced position.

2. The pluggable connector of claim 1, wherein the edge interface has an exposed perimeter that includes the mating edge and also includes opposite side edges that extend parallel to the central axis, the protective shroud covering an entirety of the side edges of the edge interface when the protective shroud is in the forward position, the edge interface being exposed to an exterior of the pluggable connector in either direction along the lateral axis when the protective shroud is in the displaced position such that objects moving along the lateral axis may enter the receiving space and engage the side edges.

3. The pluggable connector of claim 1, wherein the receiving space opens to the exterior of the pluggable connector in a mating direction along the central axis and opens to the exterior in opposite first and second lateral directions, the first and second lateral directions being along the lateral axis that is perpendicular to the central axis, wherein the first shroud side covers the receiving space that opens in the first lateral direction when the protective shroud is in the forward position and the second shroud side covers the receiving space that opens in the second lateral direction when the protective shroud is in the forward position.

4. The pluggable connector of claim 1, wherein the front wall includes a first wall portion and a second wall portion having the edge slot positioned therebetween, the first and second wall portions sliding above and below the edge interface, respectively, and along respective interface sides as the front wall is moved to the displaced position.

5. The pluggable connector of claim 1, further comprising a runner that is slidably engaged to the connector housing and coupled to and held in a fixed position with respect to the front wall, the runner including a blocking surface, the connector housing including a stop surface that faces the blocking surface, the spring member biasing the front wall such that the blocking surface engages the stop surface when the front wall is in the forward position, the stop surface and the blocking surface being spaced apart when the front wall is in the displaced position.

6. The pluggable connector of claim 1, wherein the connector housing includes first and second housing shells, each of the first and second housing shells having a base portion and a housing extension, the base portions of the first and second housing shells being engaged to each other with an interior cavity therebetween where a portion of the card assembly is disposed, each of the housing extensions extending from the respective base portion to a respective front edge and including one of the wall surfaces, the receiving space being defined between the housing extensions of the first and second housing shells and the front wall being slidable between the housing extensions.

7. The pluggable connector of claim 6, wherein the front wall includes first and second wall portions having the edge slot therebetween, the first and second wall portions sliding between the edge interface and the housing extensions of the first and second housing shells, respectively, as the front wall is moved to the displaced position.

8. The pluggable connector of claim 7, wherein the first and second wall portions have respective extension recesses, the housing extensions of the first and second housing shells sliding through the respective extensions recesses as the front wall is moved to the displaced position.

9. The pluggable connector of claim 1, wherein the connector housing includes a forward-facing wall having a spring window that extends along a lateral axis that is perpendicular to the central axis, the forward-facing wall separating the receiving space from an interior cavity of the connector housing, wherein the pluggable connector includes a spring that is positioned within the interior cavity and extends through the spring window to engage the front wall, the spring exerting a biasing force to hold the front wall in the forward position.

10. The pluggable connector of claim 1, wherein the connector housing includes first and second housing shells that are coupled to each other and have the first and second body sidewalls, respectively, the guard assembly further comprising a runner that is coupled to and held in a fixed position with respect to the front wall, the runner slidably engaging each of the first and second housing shells as the runner moves along the central axis.

11. The pluggable connector of claim 1, wherein the card assembly includes a board substrate having opposite substrate sides, the edge interface including a plug housing having the interface sides and the mating edge, wherein the plug housing is straddle-mounted to the board substrate such that the plug housing engages each of the substrate sides, the electrical contacts along the at least one interface side being electrically coupled to the board substrate.

12. The pluggable connector of claim 1, wherein the first and second shroud sides have respective exterior surfaces of the pluggable connector that face away from each other in opposite directions along the lateral axis.

* * * * *